United States Patent [19]

Vasquez et al.

[11] Patent Number: 4,865,114

[45] Date of Patent: Sep. 12, 1989

[54] PRESSURE RIG FOR REPETITIVE CASTING

[75] Inventors: Peter Vasquez; William R. Hutto, both of Newport News; Albert R. Philips, deceased, late of Hampton, all of Va., by Dora M. Philips, executrix

[73] Assignee: The United States of America as represented by the Administrator of the National Aeronautics and Space Administration, Washington, D.C.

[21] Appl. No.: 237,657

[22] Filed: Aug. 29, 1988

Related U.S. Application Data

[63] Continuation-in-part of Ser. No. 67,846, Jun. 30, 1987, abandoned.

[51] Int. Cl.[4] ..... B22D 17/00

[52] U.S. Cl. ..... 164/284; 164/113; 249/127

[58] Field of Search ..... 164/113, 284; 249/127; 425/256, 258, 447, 376 R

[56] References Cited

U.S. PATENT DOCUMENTS 2,489,280 11/1949 Flora et al. ..... 249/112
3,815,665 6/1974 Baur ..... 164/359
4,549,599 10/1985 Reiner et al. ..... 164/122.1
4,574,869 3/1986 Reinkl et al. ..... 164/360

*Primary Examiner*—Richard K. Seidel
*Attorney, Agent, or Firm*—George F. Helfrich; Manning John R.; Charles E. B. Glenn

[57] ABSTRACT

The invention is a pressure rig for repetitive casting of metal. The pressure rig performs like a piston for feeding molten metal into a mold. Pressure is applied to an expandable rubber diaphragm 22 which expands like a balloon to force the metal into the mold. A ceramic cavity 26 which holds molten metal is lined with blanket-type insulating material 11, 15, necessitating only a relining for subsequent use and eliminating the lengthy cavity preparation inherent in previous rigs. In addition, the expandable rubber diaphragm 22 is protected by the insulating material 14 thereby decreasing its vulnerability to heat damage. As a result of the improved design the like expectancy of the pressure rig contemplated by the present invention if more than doubled. Moreover, the improved heat protection has allowed the casting of brass and other alloys with higher melting temperatures than possible in conventional pressure rigs.

4 Claims, 2 Drawing Sheets

PRESSURE RIG FOR REPETITIVE CASTING

ORIGIN OF THE INVENTION

The invention described herein was made by employees of the United States Government and may be manufactured and used by or for the Government for governmental purposes without the payment of any royalties thereon or therefor.

CROSS REFERENCE TO RELATED APPLICATION

This is a continuation-in-part application of patent application Ser. No. 07/067,846, filed June 30, 1987, now abandoned.

BACKGROUND OF THE INVENTION

This invention relates to casting devices, and more particularly, to pressure rigs for repetitive casting of metals.

The casting of high quality models is essential for accurate wind tunnel test results. Conventional pressure rigs are designed only for the casting of such low-melting temperature alloys as those based on aluminum or magnesium. Each casting in conventional rigs requires repreparation of the pressure rig cavity, often lasting several days due to lengthy heating and drying operations to prepare the standard ceramic mold. In addition, the heat necessary for preparation and casting drastically decreases the life of expanding rubber diaphragms and other components.

Accordingly, it is an object of this invention to reduce the time required to prepare a pressure rig for casting metals.

A further object of this invention is to protect the rubber diaphragms and other components of pressure rigs from the extreme heat necessary for preparation and casting, thereby decreasing their vulnerability to heat damage.

A further object of this invention is to improve the quality of the casting by eliminating moisture from the pressure rig cavity.

A further object of this invention is to improve the quality of the casting by applying a more uniform pressure to the pressure rig.

A further object of this invention is to provide a pressure rig which is able to cast alloys with higher melting temperatures, such as brass.

Other objects and advantages of this invention will become apparent hereinafter in the specification and drawings which follow.

SUMMARY OF THE INVENTION

According to the present invention, the foregoing and additional objects are attained by providing a pressure rig which performs like a piston for feeding molten metal into a mold. Pressure is applied to an expandable rubber diaphragm which expands like a balloon to force molten metal into the mold. A ceramic cavity which holds the molten metal is lined with blanket-type insulating material, necessitating only a relining for subsequent use and eliminating the lengthy cavity preparation inherent in previous rigs. In addition, the expandable rubber diaphragm is protected by the insulating material thereby decreasing its vulnerability to heat damage. As a result of the improved design, the life expectancy of the pressure rig contemplated by the present invention is more than doubled. Moreover, the improved heat protection has allowed the casting of brass and other alloys with higher melting temperatures than possible in conventional pressure rigs. Very beneficial results have been obtained using Fiberfrax ®, commercially available from Harbison-Carborundum Corp., as insulating material.

DETAILED DESCRIPTION OF THE INVENTION

Figure 1:
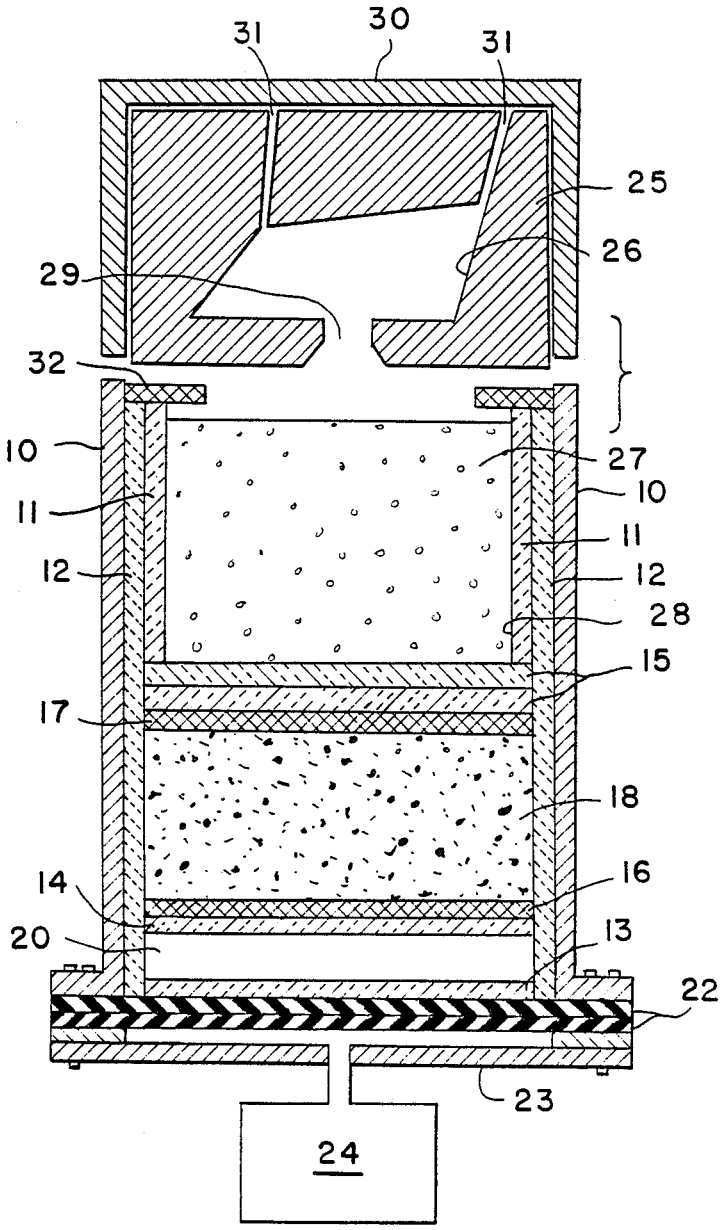
FIG. 1 is a cross-sectional view of a preferred embodiment of the present invention showing the positions of components prior to the application of pressure.

As illustrated in FIG. 1, the present invention comprehends a hollow ceramic inner shell 12 housed inside an outer steel housing 10. The lower end of the steel housing 10 is closed by a pressure plate 23, above which is attached an expandable rubber diaphragm 22 to which pressure is applied by pressure means 24. A first layer of blanket insulating material 13 lines the upper side of the rubber diaphragm 22 to protect the diaphragm from heat damage. A slideable transit plate 20 is located above the first layer of blanket insulating material 13 and is itself lined with a second layer of blanket insulating material 14 along its upper side. A layer of filler material 18, such as sand, surrounded by two nonasbestos gaskets 16 and 17 is located above the second layer of blanket insulating material 14 and serves as both an insulator and a means for varying the amount of molten material to be cast. The inside wall of the upper portion of the pressure rig is lined with a layer of blanket insulating material 11, and the upper gasket 17 is covered with more blanket insulating material 15, thereby defining an inner cavity 26 wherein the molten casting material 27 is located. An upper cap 30 with a gasket 32 seals the upper end of the casting rig and contains the mold 25, which typically has an inner cavity 26, an inlet 29, and pressure relief means 31.

Figure 2:
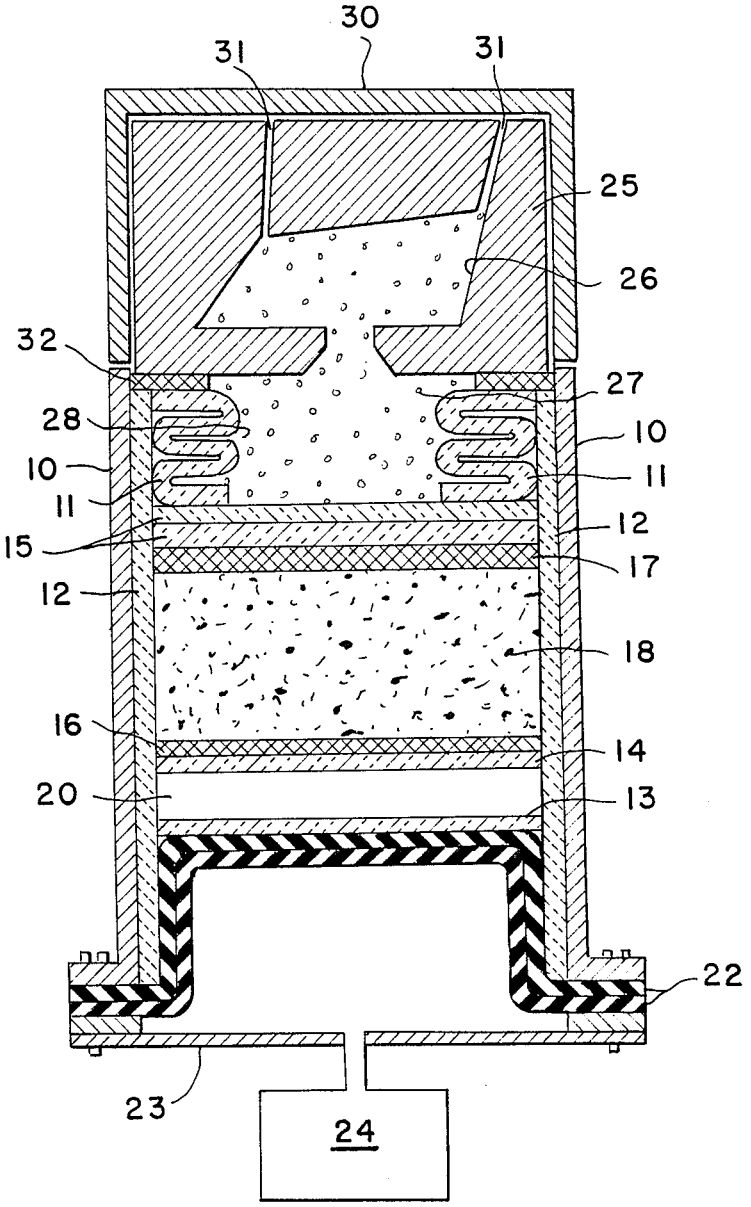
FIG. 2 is a cross-sectional view of a preferred embodiment of the present invention after application of pressure showing the changed positions of the components and showing metal injected into a representative mold.

In operation, molten casting material 27 is placed in inner cavity 28 and then the upper cap 30 is affixed to the top of the casting rig. Pressure means 24 applies a pressure to rubber diaphragm 22 which expands, forcing slideable transit plate 20 upward (see FIG. 2). The transit plate 20 in turn forces blanket insulating material 14, filler material 18, and non-asbestos gaskets 16 and 17 upward. As a result, a uniform upward force is exerted on the lower end of the pressure rig cavity where it is covered by blanket material 15, causing it to move upward. As the lower end of the casting rig cavity moves upward, the blanket material lining the walls of the cavity 11 collapses and the molten metal moves upward. Gasket 32 prevents the molten casting material 27 from escaping between the steel housing 10 and the upper cap 30, so it is forced into the mold cavity 26 by way of the inlet 29. Trapped air is vented through pressure relief passages 31.

The pressure rig may be reprepared for casting by simply relining the rig with layers of the blanket insulator material 11 and 15. The use of this insulator material prevents moisture in the ceramic liner from coming into contact with the material to be cast and protects the rubber diaphragm 22 from heat damage. Very beneficial results have been obtained using Fiberfrax ®, commercially available from Harbison-Carborundum Corp., as the blanket insulation material.

It should be obvious to those skilled in the art that this invention is not limited to the preferred embodiment shown and described.

What is claimed is:

1. A pressure rig for repetitive casting comprising a hollow ceramic inner shell;

an outer steel housing disposed around the outside of said ceramic inner shell, said housing having a pressure end at the lower end thereof and a mold end at the upper end thereof;

a rubber diaphragm attached to the pressure end of said outer steel housing;

a slideable transit plate located above said rubber diaphragm;

a layer of blanket insulating material lining the remaining portion of said hollow ceramic inner shell, thereby defining an inner cavity wherein a casting material is located;

a pressure means located at the lower end of the pressure rig for applying pressure to the lower end of said rubber diaphragm;

whereby the casting material in the inner cavity is forced out of the pressure rig into a mold when pressure is applied to the lower end of said rubber diaphragm.

2. A pressure rig according to claim 1 further comprising a first layer of blanket insulating material lining the portion of said rubber diaphragm bounded by the hollow ceramic inner shell;

a second layer of blanket insulating material lining the upper side of said slideable transit plate.

3. A pressure rig according to claim 2 further comprising a layer of filler material above said second layer of blanket insulating material.

4. A pressure rig according to claim 3 wherein said filler material is sand.

* * * * *